US008403419B2

(12) United States Patent
Damrow et al.

(10) Patent No.: US 8,403,419 B2
(45) Date of Patent: Mar. 26, 2013

(54) BENCH FOR TIGHTENING SKATE LACES

(76) Inventors: David R. Damrow, Schofield, WI (US); Randy J. Damrow, Wausau, WI (US)

( * ) Notice: Subject to any disclaimer, the term of this patent is extended or adjusted under 35 U.S.C. 154(b) by 58 days.

(21) Appl. No.: 12/985,666

(22) Filed: Jan. 6, 2011

(65) Prior Publication Data

US 2012/0175923 A1 Jul. 12, 2012

(51) Int. Cl.
*A47C 7/50* (2006.01)
*A47C 16/02* (2006.01)
*A47C 13/00* (2006.01)

(52) U.S. Cl. ..... 297/423.14; 297/423.39; 297/423.41; 182/33

(58) Field of Classification Search ..... 297/423.14, 297/423.39, 423.41; 182/33
See application file for complete search history.

(56) References Cited

U.S. PATENT DOCUMENTS

| | | | | | |
|---|---|---|---|---|---|
| 436,092 | A | * | 9/1890 | Wetherell | 297/423.14 |
| 461,974 | A | * | 10/1891 | Button | 297/423.14 X |
| 472,205 | A | * | 4/1892 | Button | 297/423.14 X |
| 615,058 | A | | 11/1898 | Cummings | |
| 931,725 | A | | 8/1909 | Blackmon | |
| 975,852 | A | * | 11/1910 | Gassel | 297/423.14 X |
| 1,049,779 | A | * | 1/1913 | Taussig | 297/423.14 |
| 1,125,155 | A | * | 1/1915 | Nunn | 297/423.14 X |
| 1,384,675 | A | * | 7/1921 | Riley | 297/423.14 X |
| 1,396,100 | A | * | 11/1921 | Davis et al. | 297/423.14 |
| 1,460,915 | A | | 7/1923 | Luton | |
| 1,486,118 | A | * | 3/1924 | Bain | 297/423.41 X |
| 1,618,221 | A | * | 2/1927 | Pertram | 297/423.14 X |
| 2,096,551 | A | * | 10/1937 | Johnson | 297/423.14 X |
| 2,267,158 | A | * | 12/1941 | Locke | 297/423.14 X |
| 2,446,601 | A | * | 8/1948 | Lelyveld | 297/423.14 X |
| 2,719,569 | A | * | 10/1955 | Kramer | 297/423.14 X |
| 2,969,829 | A | | 1/1961 | Henry | |
| 3,155,364 | A | * | 11/1964 | Berg | 297/423.45 X |
| 3,271,075 | A | * | 9/1966 | Good | 297/423.41 |
| 4,131,196 | A | | 12/1978 | Csutor | |
| 4,228,745 | A | * | 10/1980 | Gale | 297/423.45 X |
| 4,383,488 | A | * | 5/1983 | Macho et al. | 108/129 |
| 4,394,042 | A | | 7/1983 | Smith | |
| 4,462,636 | A | * | 7/1984 | Markson | 297/423.41 |
| 4,471,969 | A | * | 9/1984 | Zabala et al. | 297/423.41 X |
| 4,550,802 | A | * | 11/1985 | Roper | 182/113 |
| 4,991,908 | A | * | 2/1991 | Krechel | 297/423.41 |
| 5,244,255 | A | * | 9/1993 | Mill | 297/423.41 |
| 6,454,357 | B1 | * | 9/2002 | Foulger | 297/423.41 |
| 6,568,506 | B1 | * | 5/2003 | Donnalley | 182/223 |
| 6,966,404 | B2 | * | 11/2005 | Meeker | 182/33 |
| 7,007,771 | B2 | * | 3/2006 | Rawlings et al. | 182/33 |
| 8,240,769 | B1 | * | 8/2012 | Story et al. | 297/423.41 |

* cited by examiner

*Primary Examiner* — Rodney B White
(74) *Attorney, Agent, or Firm* — Andrus, Sceales, Starke & Sawall, LLP

(57) ABSTRACT

A bench is used to support and provide access to a skate in an elevated position relative to a floor surface. The bench includes a seat portion having a sitting surface provided thereon, and a leg structure mounted to the seat portion and adapted to support the seat portion relative to the floor surface. A support portion is connected to the seat portion and provided with a through-slotted support surface adapted to receive and support a skate. The support surface includes at least one through-slot formed longitudinally thereof and dimensioned to receive a depending structure provided on a sole of the skate.

22 Claims, 3 Drawing Sheets

BENCH FOR TIGHTENING SKATE LACES

FIELD OF THE INVENTION

The present disclosure relates generally to aids and accessories employed in preparing skates for use. More specifically, the present disclosure pertains to a portable bench used in supporting a skate in a convenient position to permit easy access thereto, particularly for tightening and securing a lace of the skate.

BACKGROUND OF THE INVENTION

It is necessary in donning footwear, such as skates, to secure the right amount of tension in or tightening of the laces to properly support the ankle, but without having portions thereof unnecessarily tight to interfere with circulation. However, obtaining the proper tensioning is often beyond the capability of young skaters so that parents/coaches are called upon to tighten and secure laces so as to obtain the proper ankle support which will enable a good skating performance while still providing foot comfort.

Oftentimes, it can be difficult for a coach or parent to tighten and secure the laces of young skaters due to the fact that, typically, one must stoop down or bend over to a floor surface on which the skate is supported. Coaches/parents can thus experience inconvenience, discomfort and considerable difficulty in performing this normally simple function.

Therefore, it is desirable to provide a skater's aid in the form of a bench having a seating portion and a skate-supporting portion that will conveniently enable a parent/coach to attend to lacing functions while seated with the skate being supported in an elevated position above the floor surface.

SUMMARY OF THE INVENTION

The present disclosure relates to a bench adapted to support and provide access to a skate in an elevated position relative to a floor surface. The bench includes a seat portion having a sitting surface provided thereon, and a leg structure mounted to the seat portion and adapted to support the seat portion relative to the floor surface. A support portion is connected to the seat portion and provided with a through-slotted support surface adapted to receive and support a skate. The support surface includes at least one through-slot formed longitudinally thereof.

The support surface is formed with an unobstructed periphery. The through-slot is formed with a substantially constant width along a length thereof. The seat portion defines a storage cavity located beneath the sitting surface. The leg structure includes a set of legs pivotally connected to the seat portion and movable between an extended position adapted to engage the floor surface and a retracted position located beneath the sitting surface. The support portion is pivotally secured to the seat portion and movable between an extended position adapted to engage the floor surface, and a retracted position beneath the sitting surface such that the support surface is substantially parallel to the sitting surface. The leg structure includes a set of spring-biased detents and the seat portion includes a set of detent-receiving apertures for holding the leg structure in extended and retracted positions relative to the seat portion. The seat portion includes front, rear and opposed side walls which extend downwardly from the periphery of the sitting surface. The leg structure includes a first leg panel pivotally connected at a rear end of the seat portion, and a second leg panel pivotally connected at a front end of the seat portion. The first leg panel is movable to a retracted position directly beneath the sitting surface, the second leg panel is movable to a retracted position beneath the first leg panel in its retracted position and the support portion is movable to a retracted position beneath the second leg panel in its retracted position. The second leg panel and the support portion are pivotable about a common pivot axis.

The present disclosure further relates to a bench constructed to support and provide access to lacing of a skate in an elevated position relative to a floor surface. The bench includes a seat portion having a sitting surface, and a leg structure attached to the seat portion and configured to support the seat portion relative to the floor surface. A support portion has a rear end connected to the seat portion, and a front end spaced and disconnected from the seat portion and the leg structure, and configured to engage the floor surface. The support portion is provided with at least one through-slot formed longitudinally thereof and dimensioned to receive a depending structure provided on a sole of a skate. The through-slot is surrounded by a support surface configured to support the sole of the skate and formed with an unobstructed periphery.

A wall forming the through-slot defines a path of travel configured to guide the dependent structure of the skate to a desired position longitudinally of the support surface. The leg structure and the support portion are movably mounted on the seat portion between extended positions engageable with the floor surface to retracted positions in which external surfaces of the leg structure and the support surface lie substantially parallel to one another beneath the sitting surface. The leg structure is pivotally mounted to the seat portion from an extended position engageable with the floor surface to a retracted position within a storage cavity formed beneath the sitting surface. One of the leg structure and seat portion includes a set of spring-biased detents and the other leg structure and the seat portion includes a set of detent-receiving apertures for holding the leg structure in extended and retracted positions. The leg structure includes a first leg panel pivotally mounted to a rear end of the seat portion, and a second leg panel pivotally mounted to a front end of the seat portion. The first and second leg panels are pivoted in opposite directions from extended positions engageable with the floor surface to retracted positions beneath the sitting surface.

The present disclosure further relates to a portable, collapsible bench adapted for supporting a skate in an elevated position relative to a floor surface. The bench includes a seat portion having a sitting surface provided thereon, and a leg structure mounted to the seat portion and adapted to support the seat portion relative to the floor surface. A support portion is connected to the seat portion and provided with a through-slotted support surface adapted to receive and support a skate. The support surface includes at least one through-slot formed longitudinally thereof. The leg structure and the support portion are movably mounted on the seat portion between extended positions adapted to be engaged with the floor surface, and retracted positions in which the external surfaces of the leg structure and the support surface lie in parallel relationship to one another and the sitting surface.

BRIEF DESCRIPTION OF THE DRAWINGS

The drawings illustrate the best mode presently contemplated of carrying out the disclosure. In the drawings.

DETAILED DESCRIPTION

Figure 1:
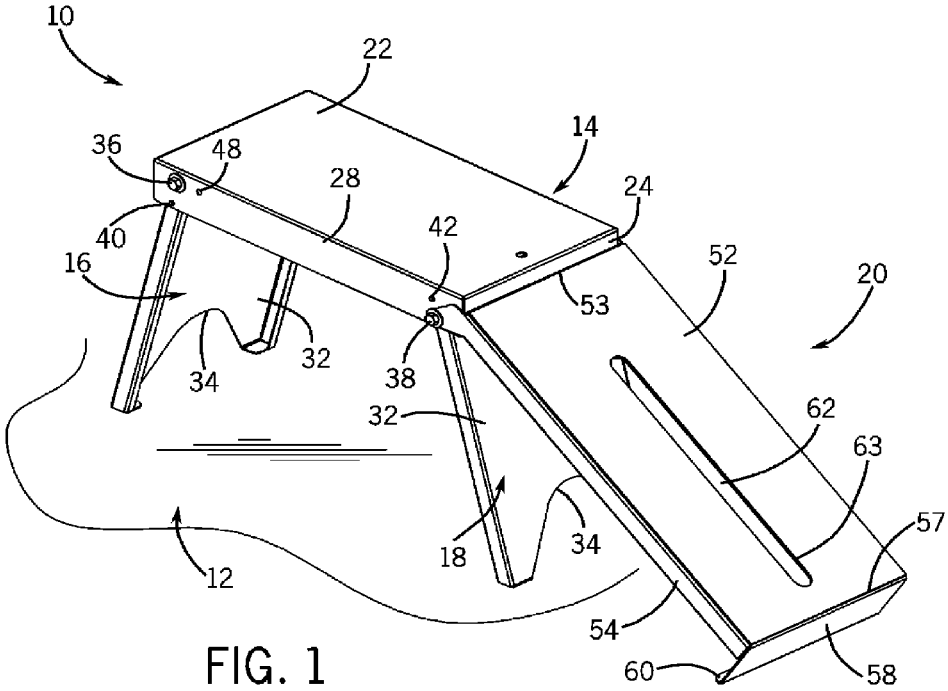
FIG. 1 is a perspective view of a skate-supporting bench according to the present disclosure.

Referring now to the drawings, FIGS. 1-6 illustrate an exemplary embodiment of a portable, collapsible skate-supporting bench 10 adapted to be used on a floor surface 12, such as may lie adjacent a skating venue.

The bench 10 includes a seat portion 14, a leg structure having a pair of rear and front legs 16, 18, respectively, for supporting the seat portion 14 upon the floor surface 12. The bench 10 further includes a support portion 20 adapted to receive and support a skate to permit ready access thereto from the seat portion 14 at an elevated position relative to the floor surface 12.

The seat portion 14 has a generally rectangular, flat sitting surface 22 provided with a front wall 24, a rear wall 26, and a pair of opposed side walls 28, 30. Each of the walls 24, 26, 28, 30 depends downwardly from peripheral edges of the sitting surface 22, and forms therewith a storage cavity beneath the sitting surface 22.

Both legs 16, 18 are preferably constructed as generally rectangular panels 32 having material-receiving recesses 34 formed in lower portions thereof. An upper end of rear leg 16 is pivotally attached by means of a bolt 36 to an upper rear end of the seat portion 14. An upper end of front leg 18 is pivotally secured by means of a bolt 38 to a lower front end of the seat portion 14.

Figure 2:
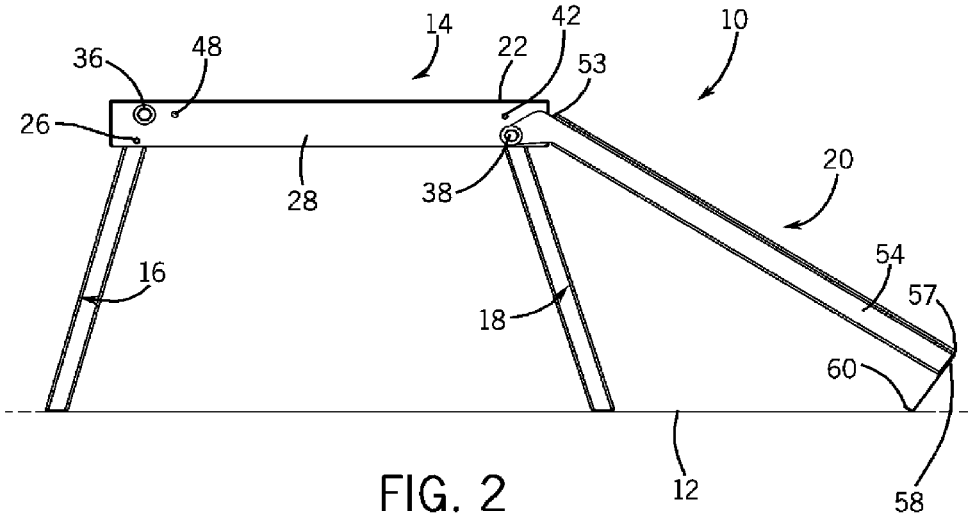
FIG. 2 is a side elevational view of the bench shown in FIG. 1.
Figure 3:
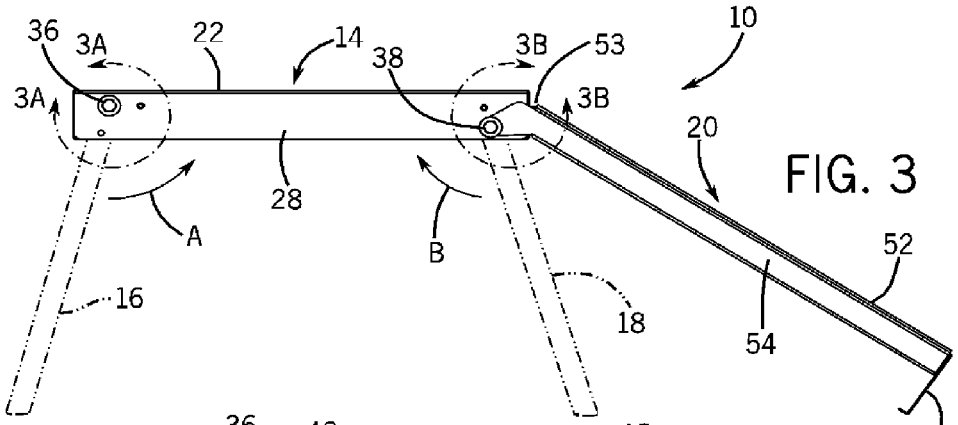
FIG. 3 is a view similar to FIG. 2 depicting pivoting of the legs of the bench from an operative position to a storage position.
Figure 3A:
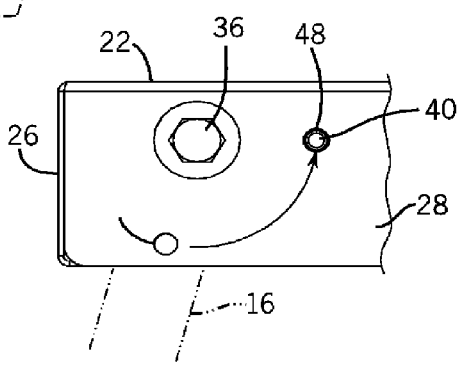
FIG. 3A is an enlarged detail view taken on line 3A-3A of FIG. 3.
Figure 3B:
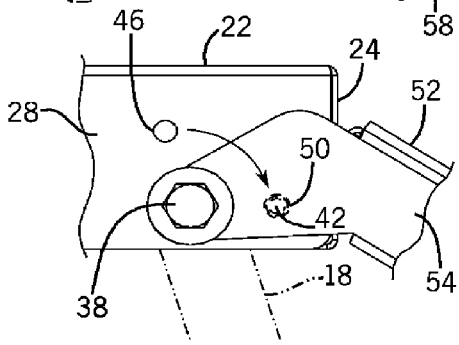
FIG. 3B is an enlarged detail view taken on line 3B-3B of FIG. 3.
Figure 5:
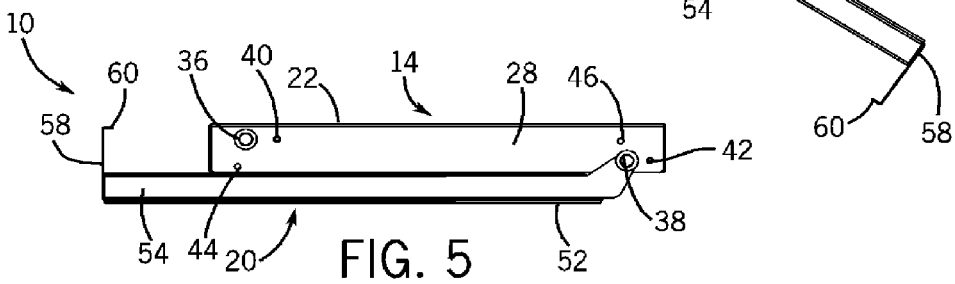
FIG. 5 is a view of the bench in a collapsed, inoperative position.
Figure 6:
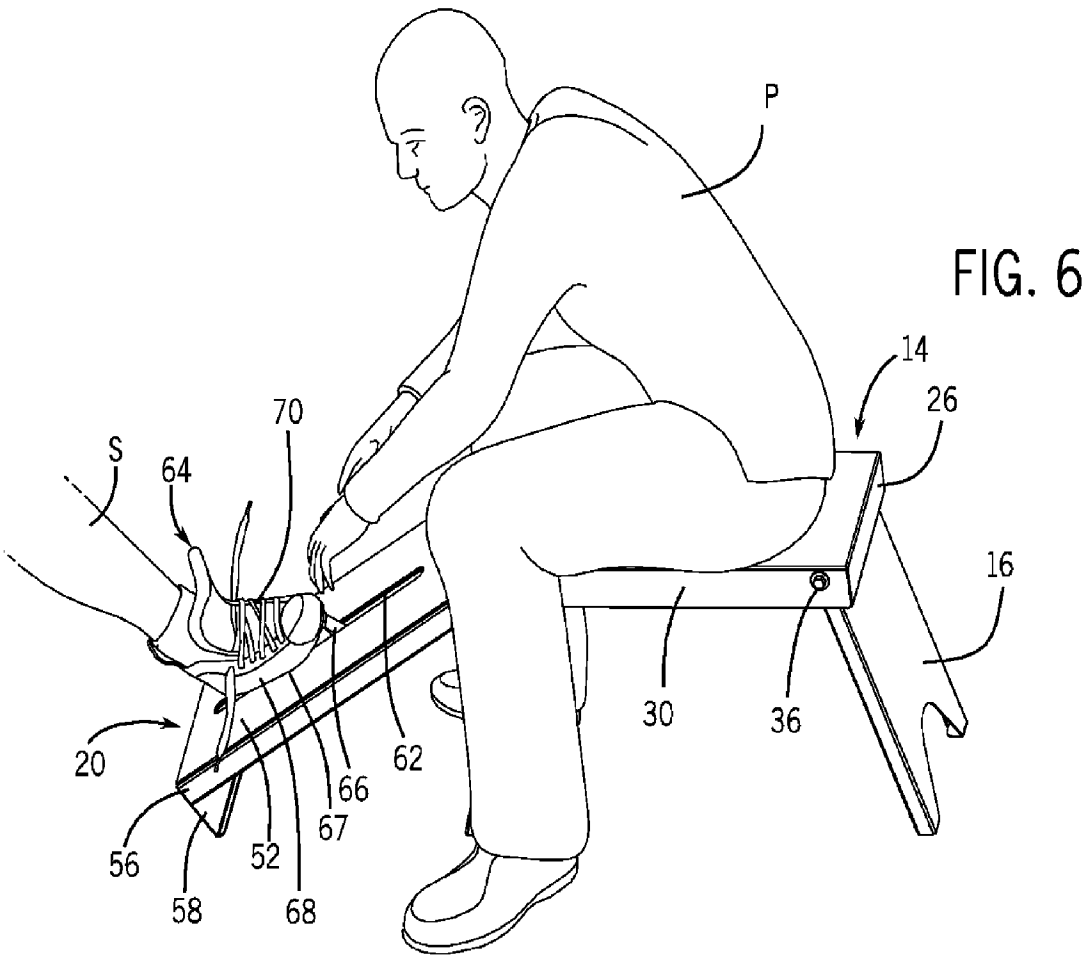
FIG. 6 is a perspective view of the bench of FIG. 1 in an extended operative position.

When the bench 10 is in use and in an operative position, and legs 16, 18 are held in outwardly and downwardly angled and extended positions as shown in FIGS. 1, 2 and 6 by means of a pair of spring-biased detents 40, 42 operably connected to the legs 16, 18. With the legs 16, 18 in their extended positions, the detents 40, 42 are respectively engaged with the walls of suitable apertures 44, 46 (FIG. 5) formed in the side wall 28 at respective rear and front ends of the seat portion 14. As best seen in FIGS. 3A and 3B, additional apertures 48, 50 are also formed in the side wall 28 at respective rear and front ends of the seat portion 14. The detents 40, 42 and apertures 44, 46, 48, 50 form a preferred retaining arrangement for holding the leg structure 16, 18 in extended and retracted positions. Disengaging the detents 40, 42 from the walls of respective apertures 44, 46 allows the legs 16, 18 to separately pivot or fold in opposite directions represented by arrows A and B, respectively, towards retracted positions within the storage cavity defined beneath the sitting surface 22. In the retracted positions, the detents 40, 42 of the legs 16, 18 become engaged with walls of apertures 48, 50, respectively.

The support portion 20 has a generally rectangular, flat elongated support surface 52 having an unobstructed periphery with a back edge 53 and side frames 54, 56 which are pivotally connected at upper ends thereof to bolt 38. The support portion 20 and the leg 18 are commonly pivoted about a pivot axis defined by bolt 38. A front edge 57 of the support surface 52 includes a downwardly depending front wall 58 terminating at an inwardly projecting finger 60. A bottom edge of the front wall 58 is engageable with the floor surface 12 so that the support surface 52 slopes downwardly at the front end 24 of seat portion 14 to an extended position raised from the floor surface 12 when the bench 10 is in use.

A distinctive feature of the support portion 20 resides in a receiver arrangement formed therein for supporting and positioning a skate in a convenient position between the seat portion 14 and the floor surface 12. In the example shown, the receiver arrangement is configured with at least one slot such as a single continuous through-slot 62 which is formed longitudinally along and entirely through a central portion of the support surface 52. However, it should be understood that the receiver arrangement may also be formed with other suitable structure and configurations.

Figure 4:
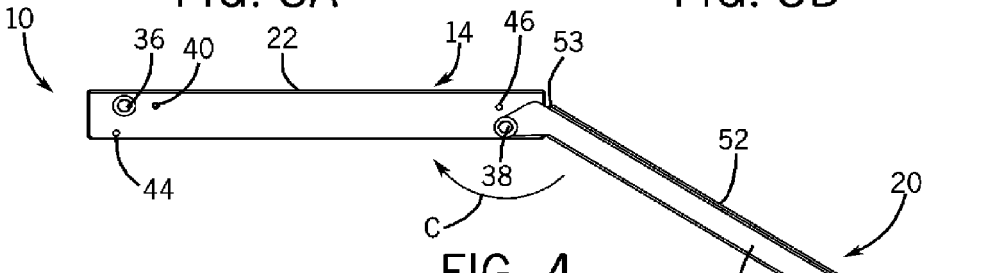
FIG. 4 is a view similar to FIG. 3 showing the pivoting of a skate-supporting portion of the bench from an operative position to a storage position.

The through-slot 62 is surrounded by the flat support surface 52 and it is dimensioned with a suitable length, width and depth to receive a sheathed or unsheathed depending structure of a skate boot which is designed to glide along a surface in normal use propelled by alternate actions of one's legs. In the example shown, the through-slot 62 has a substantially constant width along a length thereof. A wall 63 defining the through-slot 62 defines a path of travel configured to guide the depending structure of the skate to a desired position longitudinally of the support surface 52 between opposite ends of wall 63. As depicted in FIG. 4, the support portion 20 can be pivoted or folded in the direction of arrow C from an extended position towards a retracted position once the legs 16, 18 have been retracted. FIG. 5 shows a support portion 20 fully retracted against the bottom of seat portion 14 so that the bench 10 is in a collapsed, inoperative position. In the retracted position, the support surface 52 is pivoted beneath seat portion 14 so that it is substantially parallel to the sitting surface 22 as well as the external surfaces of the retracted legs 16, 18 located within the storage cavity of the seat portion 14.

An exemplary use of the bench 10 in an extended, operative position is depicted in FIG. 6 wherein a person P, such as a coach or parent, sits in a straddled fashion upon the seat portion 14 facing forwardly towards the support portion 20. A skater S having loosely put on an ice skate 64 places a depending structure 66 of a skate boot 68 in the through-slot 62, such that a bottom surface of sole 67 of the skate boot 68 surrounding the depending structure 66 is supported in a stable manner on the support surface 52 adjacent the through-slot 62 and raised from the floor surface 12. The ice skate 64 can be suitably positioned along the through-slot 62 to permit easy access to the hands of a seated coach or parent P who may then comfortably attend to preparing the skate 64 for use, such as by tightening and securing a lace 70 thereof. The bench 10 likewise enables a coach or parent P to perform other attendant functions, such as lacing or relacing ice skate 64, or applying a protective coating or accessory to the skate boot 68, if desired.

In the example described above, the receiver arrangement of the bench 10 is shown in use with a single through-slot 62 extending generally midway between the edges 53 and 57 for receiving a single depending structure 66 of an ice skate 64 which could be a sheathed or unsheathed blade. The single through-slot 62 could also be used to receive an inline design of a roller skate with a single row of rollers. However, it should be appreciated that the receiver arrangement of bench 10 is not limited to such single through-slot 62 and could be suitably configured to receive the depending structure of other skate constructions. For example, a roller skate design with two rolls of rollers or a dual depending blade structure of certain ice skates would require two slots in the support portion 20.

Once the bench 10 has been used to access the skates 64, the bench 10 can be collapsed by releasing detent 40 and pivoting leg 16 directly beneath the sitting surface 22. Then, detent 42 is released allowing pivoting of leg 18 beneath retracted leg 16 so that both legs 16, 18 lie within the storage cavity of seat portion 14. Finally, support portion 20 may be pivoted beneath the legs 16, 18 and bottom edge of seat portion 20 as shown in FIG. 5.

Various alternatives are contemplated as being within the scope of the following claims particularly pointing out and distinctly claiming the subject matter regarded as the invention.

What is claimed is:

1. A bench adapted to support and provide access to a skate in an elevated position relative to a floor surface, the bench comprising:

a seat portion having a sitting surface provided thereon;

a leg structure mounted to the seat portion and adapted to support the seat portion relative to the floor surface; and a support portion connected to the seat portion and provided with a through-slotted support surface adapted to receive and support a skate, the support surface including at least one through-slot formed longitudinally thereof, wherein the leg structure is movable from an extended position adapted to engage the floor surface to a retracted position directly beneath the sitting surface, and the support portion is movable from an extended position adapted to engage the floor surface to a retracted position lying beneath the leg structure in its retracted position.

2. The bench of claim 1, wherein the support surface is formed with an unobstructed periphery.

3. The bench of claim 1, wherein the through-slot is formed with a substantially constant width along a length thereof.

4. The bench of claim 1, wherein the seat portion defines a storage cavity located beneath the sitting surface.

5. The bench of claim 1, wherein the leg structure includes a set of legs pivotally connected to the seat portion and movable between the extended position adapted to engage the floor surface, and the retracted position located beneath the sitting surface.

6. The bench of claim 1, wherein the support portion is pivotally secured to the seat portion and movable between the extended position adapted to engage the floor surface, and the retracted position beneath the sitting surface such that the support surface is substantially parallel to the sitting surface.

7. The bench of claim 1, wherein the leg structure includes a set of spring-biased detents and the seat portion includes a set of detent-receiving apertures for holding the leg structure in the extended and retracted positions relative to the seat portion.

8. The bench of claim 1, wherein the seat portion includes front, rear and opposed side walls which extend downwardly from a periphery of the sitting surface.

9. The bench of claim 1, wherein the leg structure includes a first leg panel pivotally connected to a rear end of the seat portion, and a second leg panel pivotally connected at a front end of the seat portion.

10. The bench of claim 9, wherein the first leg panel is movable to a first retracted position directly beneath the sitting surface, the second leg panel is movable to a second retracted position beneath the first leg panel in its retracted position, and the support portion is movable to a third retracted position beneath the second leg panel in its retracted position.

11. The bench of claim 9, wherein the second leg panel and support portion are pivotable about a common pivot axis.

12. A bench constructed to support and provide access to lacing of a skate in an elevated position relative to a floor surface, the bench comprising:

a seat portion having a sitting surface;

a leg structure attached to the seat portion and configured to support the seat portion relative to the floor surface; and a support portion having a rear end connected to the seat portion, and a front end configured to engage the floor surface, the support portion being provided with at least one through-slot formed longitudinally thereof and dimensioned to receive a dependent structure provided on a sole of the skate, the through-slot being surrounded by a support surface disconnected from the leg structure, configured to support the sole of the skate and formed with an unobstructed periphery, wherein the leg structure is movable from an extended position engaged with the floor surface and a retracted position directly beneath the sitting surface, and the support portion is movable from an extended position engaged with the floor surface to a retracted position lying beneath the leg structure in its retracted position.

13. The bench of claim 12, wherein a wall forming the through-slot defines a path of travel configured to guide the depending structure of the skate to a desired position longitudinally of the support surface.

14. The bench of claim 12, wherein the leg structure and the support portion are movably mounted on the seat portion between the extended positions engageable with the floor surface to the retracted positions in which external surfaces of the leg structure and the support surface lie substantially parallel to one another beneath the sitting surface.

15. The bench of claim 12, wherein the leg structure is pivotally mounted on the seat portion from the extended position engageable with the floor surface to the retracted position within a storage cavity formed beneath the sitting surface.

16. The bench of claim 12, wherein the support portion is pivotally mounted on the seat portion from the extended portion engageable with the floor surface to the retracted position beneath the seat portion.

17. The bench of claim 12, wherein the leg structure and the seat portion are formed with a retaining arrangement for holding the leg structure in the extended and retracted positions relative to the seat portion.

18. The bench of claim 12, wherein one of the leg structure and the seat portion includes a set of spring-biased detents and the other of the leg structure and seat portion includes a set of detent-receiving apertures for holding the leg structure in the extended and retracted positions.

19. The bench of claim 12, wherein the leg structure includes a first leg panel pivotally connected to the rear end of the seat portion and a second leg panel pivotally mounted to a front end of the seat portion, the first and second leg panels being pivoted in opposite directions from extended positions engageable with the floor surface to retracted positions beneath the sitting surface.

20. A portable, collapsible bench adapted for supporting a skate in an elevated position relative to a floor surface, the bench comprising:

a seat portion having a sitting surface provided thereon;

a leg structure mounted to the seat portion and adapted to support the seat portion relative to the floor structure; and a support portion connected to the seat portion and provided with a through-slotted support surface adapted to receive and support a skate, the support surface including at least one through-slot formed longitudinally thereof, wherein the leg structure and the support portion are movably mounted on the seat portion between extended positions adapted to be engaged with the floor surface, and retracted positions in which the external surfaces of the leg structure and the support surface lie in substantially parallel relationship to one another and the sitting surface, the leg structure being movable to one of the retracted positions within a storage cavity formed beneath the sitting surface, and the support portion being movable to another of the retracted positions beneath the leg structure in its retracted position and a bottom edge of the seat portion.

21. A bench adapted to support and provide access to a skate in an elevated position relative to a floor surface, the bench comprising:

a seat portion having a sitting surface provided thereon;

a leg structure mounted to the seat portion in an extended position and adapted to support the seat portion relative to the floor surface; and a support portion connected to the seat portion and provided with a through-slotted support surface adapted to receive and support a skate, the support surface including at least one through-slot formed longitudinally thereof, wherein the leg structure includes a first leg panel pivotally connected to a rear end of the seat portion, and a second leg panel pivotally connected at a front end of the seat portion, and wherein the first leg panel is movable to a retracted position directly beneath the sitting surface, the second leg panel is movable to a retracted position beneath the first leg panel in its retracted position, and the support portion is movable to a retracted position beneath the second leg panel in its retracted position.

22. A bench constructed to support and provide access to lacing of a skate in an elevated position relative to a floor surface, the bench comprising:

a seat portion having a sitting surface;

a leg structure attached to the seat portion and configured to support the seat portion relative to the floor surface and a support portion having a rear end connected to the seat portion, and a front end spaced and disconnected from the seat portion and the leg structure, and configured to engage the floor surface, the support portion being provided with at least one through-slot formed longitudinally thereof and dimensioned to receive a dependent structure provided on a sole of the skate, the through-slot being surrounded by a support surface configured to support the sole of the skate and formed with an unobstructed periphery, wherein the leg structure is pivotally mounted on the seat portion from an extended position engageable with the floor surface to a retracted position within a storage cavity formed beneath the sitting surface.

* * * * *